US009073687B2

(12) United States Patent
Felix

(10) Patent No.: US 9,073,687 B2
(45) Date of Patent: Jul. 7, 2015

(54) APPARATUS AND METHOD FOR PROTECTION OR DECORATION OF OPEN-ENDED CONTAINERS

(76) Inventor: Tina Marie Felix, Dallas, TX (US)

( * ) Notice: Subject to any disclaimer, the term of this patent is extended or adjusted under 35 U.S.C. 154(b) by 0 days.

(21) Appl. No.: 13/364,617

(22) Filed: Feb. 2, 2012

(65) Prior Publication Data

US 2012/0193263 A1 Aug. 2, 2012

Related U.S. Application Data

(60) Provisional application No. 61/438,797, filed on Feb. 2, 2011.

(51) Int. Cl.
*B65D 81/03* (2006.01)

(52) U.S. Cl.
CPC ..... *B65D 81/03* (2013.01); *Y10T 29/49826* (2015.01)

(58) Field of Classification Search
CPC . B65D 81/03; B65D 85/307; Y10T 29/49826
USPC ..... 206/217–218, 426, 493, 521–523, 206/583–594; 229/87.02, 89, 90, 91
See application file for complete search history.

(56) References Cited

U.S. PATENT DOCUMENTS

| | | | | | |
|---|---|---|---|---|---|
| 906,818 | A | * | 12/1908 | Peltason | 229/90 |
| 961,885 | A | * | 6/1910 | Myers | 229/90 |
| 1,452,039 | A | * | 4/1923 | Gravell | 206/522 |
| 2,083,741 | A | * | 6/1937 | Pearson | 229/89 |
| 2,298,480 | A | * | 10/1942 | Harvey | 206/588 |
| 4,215,786 | A | * | 8/1980 | Vertes | 206/591 |
| 6,026,534 | A | | 2/2000 | Gonda et al. | |
| 7,374,045 | B2 | | 5/2008 | DiLiberto | |

* cited by examiner

*Primary Examiner* — Bryon Gehman
(74) *Attorney, Agent, or Firm* — James H. Ortega; Carstens & Cahoon, LLP

(57) ABSTRACT

A system includes an open-ended container and an apparatus. The apparatus includes a compressible lower portion adapted for insertion into a hollow interior of the open-ended container and to contact an inner surface of the open-ended container. The apparatus also includes an upper portion connected to the lower portion and adapted for placement over an outer surface of the open-ended container. The apparatus may also include an overwrap portion connected to at least one of the lower portion and the upper portion and that is adapted for placement over the outer surface of the open-ended container and over the upper portion. For example, the open-ended container could represent a drinking glass, the upper portion may be adapted for placement over at least a bowl of the drinking glass, and the overwrap portion may be adapted for placement over the bowl, a stem, and a base of the drinking glass.

20 Claims, 11 Drawing Sheets

APPARATUS AND METHOD FOR PROTECTION OR DECORATION OF OPEN-ENDED CONTAINERS

CROSS-REFERENCE TO RELATED APPLICATION AND PRIORITY CLAIM

This application claims priority under 35 U.S.C. §119(e) to U.S. Provisional Patent Application No. 61/438,797 filed on Feb. 2, 2011, which is hereby incorporated by reference.

TECHNICAL FIELD

This disclosure relates generally to protective and decorative devices. More specifically, this disclosure relates to an apparatus and method for protection or decoration of open-ended containers.

BACKGROUND

When multiple glasses, vases, or other fragile open-ended containers are packed for moving or storage, a specialized packing crate having internal dividers may be used to prevent breakage of the containers by separating the containers with a divider material that prevents the containers from impacting each other during movement of the crate. Additionally or alternatively, individual containers may be wrapped in a protective material such as "bubble wrap" or foam before being placed in a crate that may or may not have internal dividers. In still other circumstances, containers may be placed in a crate in positions separated from each other, and a cushioning material such as foam pellets may be poured into the crate to fall between the containers and prevent their impacting each other during movement of the crate.

These packing techniques require specialized crates or extensive handling of containers and/or wrapping materials. Furthermore, mistakes made in applying the techniques may result in container breakage, despite preventative efforts.

SUMMARY

This disclosure provides an apparatus and method for protection or decoration of open-ended containers.

In a first embodiment, an apparatus includes a compressible lower portion adapted for insertion into a hollow interior of an open-ended container and to contact an inner surface of the open-ended container. The apparatus also includes an upper portion connected to the lower portion and adapted for placement over an outer surface of the open-ended container.

In a second embodiment, a system includes an open-ended container and an apparatus. The apparatus includes a compressible lower portion adapted for insertion into a hollow interior of the open-ended container and to contact an inner surface of the open-ended container. The apparatus also includes an upper portion connected to the lower portion and adapted for placement over an outer surface of the open-ended container.

In a third embodiment, a method includes inserting a compressible lower portion of an apparatus into a hollow interior of an open-ended container, where the lower portion contacts an inner surface of the open-ended container. The method also includes placing an upper portion of the apparatus over an outer surface of the open-ended container, where the upper portion of the apparatus is connected to the lower portion of the apparatus.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 20, described below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIGS. 1 through 4 illustrate use of an example apparatus 100 for protection or decoration of an open-ended container in accordance with this disclosure. The embodiment of the apparatus 100 shown in FIGS. 1 through 4 is for illustration only. Other embodiments of the apparatus 100 may be used without departing from the scope of this disclosure.

Figure 1:
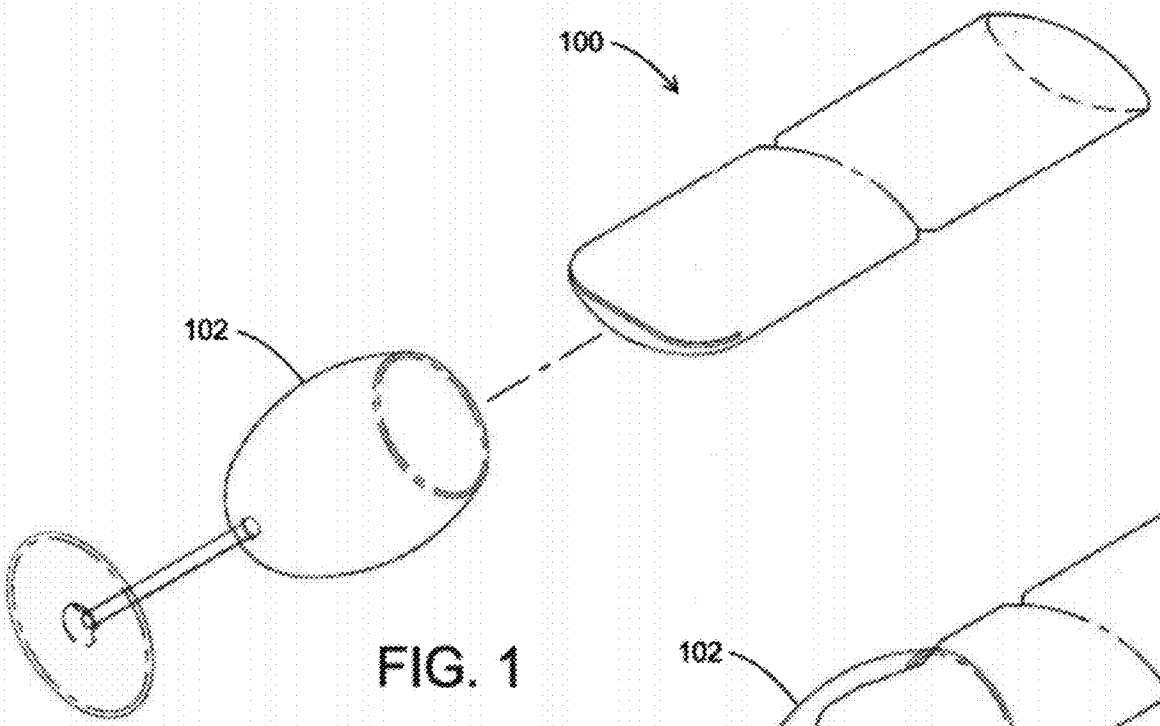
FIGS. 1 through 4 illustrate use of an example apparatus for protection or decoration of an open-ended container in accordance with this disclosure.
Figure 2:
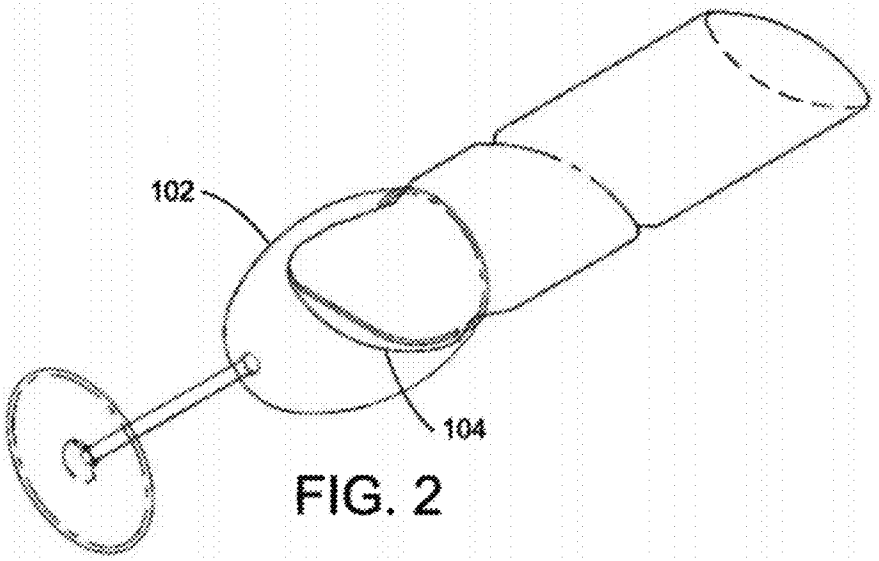

In this example embodiment, the apparatus 100 includes various components that facilitate applying pressure at a number of locations across an inner surface of a wine glass 102 or other open-ended container, as well as other components that provide for a protective covering around at least portions of an outer surface of the wine glass 102. In FIG. 1, the apparatus 100 is aligned with an open end of the wine glass 102, in preparation for inserting a portion of the apparatus 100 into a bowl of the wine glass 102. In FIG. 2, the insertion process is partially completed, and a lower portion 104 of the apparatus 100 is partially inserted into the open end of the wine glass 102.

It may be seen that the lower portion 104 of the apparatus 100 has a width or diameter before insertion that is larger than an inner diameter of the open end and the bowl of the wine glass 102. However, the lower portion 104 is made from or filled with a compressible material that permits the lower portion 104 to be compressed for insertion into the bowl of the wine glass 102.

Figure 3:
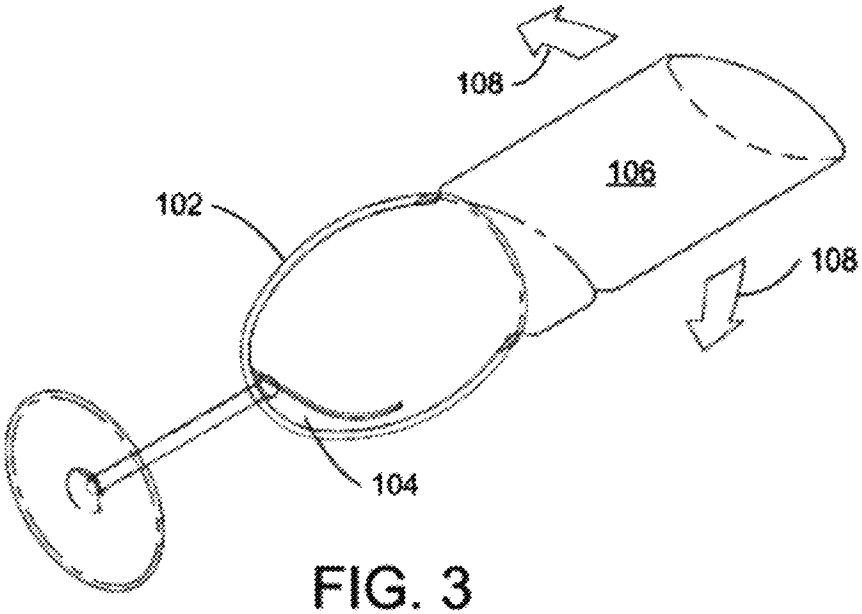

In FIG. 3, substantially all of the lower portion 104 of the apparatus 100 has been inserted into the bowl of the wine glass 102 and has expanded to fill substantially all the bowl. An outer surface of the lower portion 104 is thus in contact with an inner surface of the bowl at a number of locations. In some embodiments, the lower portion 104 is fabricated from a fabric, fine netting, or other tightly woven material surrounding a compressible material, and the lower portion 104 may contact the inner surface of the bowl at a majority of locations or along substantially all of the inner surface of the bowl. In other embodiments, the outer material of the lower portion 104 is a fishnet, burlap, or other coarse weave material, and the lower portion 104 may contact the inner surface of the bowl at a lesser number of locations. In still other embodiments, the lower portion 104 is fabricated from a compressible material such as sponge, stacked nylon netting ("shower scrunchy"), or textured foam without a woven covering, and the lower portion 104 may contact the inner surface of the bowl at a plurality of discrete, separated locations.

Regardless of whether contact between the lower portion 104 and the inner surface of the bowl is discrete or continuous, an effect of such contact is to damp vibrations in the material of the bowl (e.g., glass, pottery, porcelain, etc.) caused by an impact on an outer surface of the bowl. To a lesser extent, any resistance to compression of the material of the lower portion 104 will also resist compression of the material of the bowl caused by impact. In both cases, the pressure of the lower portion 104 against the inner surface of the bowl aids in preventing breakage of the material of the bowl caused by an impact.

FIG. 3 also shows an upper portion 106 of the apparatus 100, which remains outside the wine glass 102 when the lower portion 104 of the apparatus 100 is inserted into the bowl of the wine glass 102. The upper portion 106 is an unfilled tube that is open at an end distal from the wine glass 102. The open end of the upper portion 106 may be pulled down around opposite sides of an outer surface of the bowl of the wine glass 102 as shown by arrows 108. In some embodiments, the upper portion 106 may be made from an elastic material having a diameter smaller than the bowl, such that the material is pulled outwards to be fitted over the bowl and springs back inward to contact the outer surface of the bowl. In other embodiments, the upper portion 106 may be made from a non-elastic material having a diameter sufficiently larger than the bowl so that the material may be pulled down over the outer surface of the bowl without requiring the material to stretch.

Figure 4:
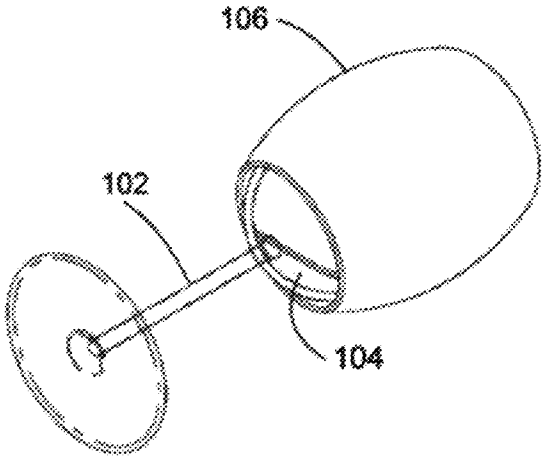

FIG. 4 illustrates the apparatus 100 fully installed on the wine glass 102. The lower portion 104 remains within the bowl of the wine glass 102, while the upper portion 106 has been pulled down or otherwise arranged to cover the outer surface of the bowl. While the upper portion 106 is only long enough to cover the bowl of the wine glass 102, it will be seen from other embodiments (described below) that the length of the upper portion 106 may alternatively be adequate also to cover a portion or all of the stem and base of the wine glass 102.

Figure 5:
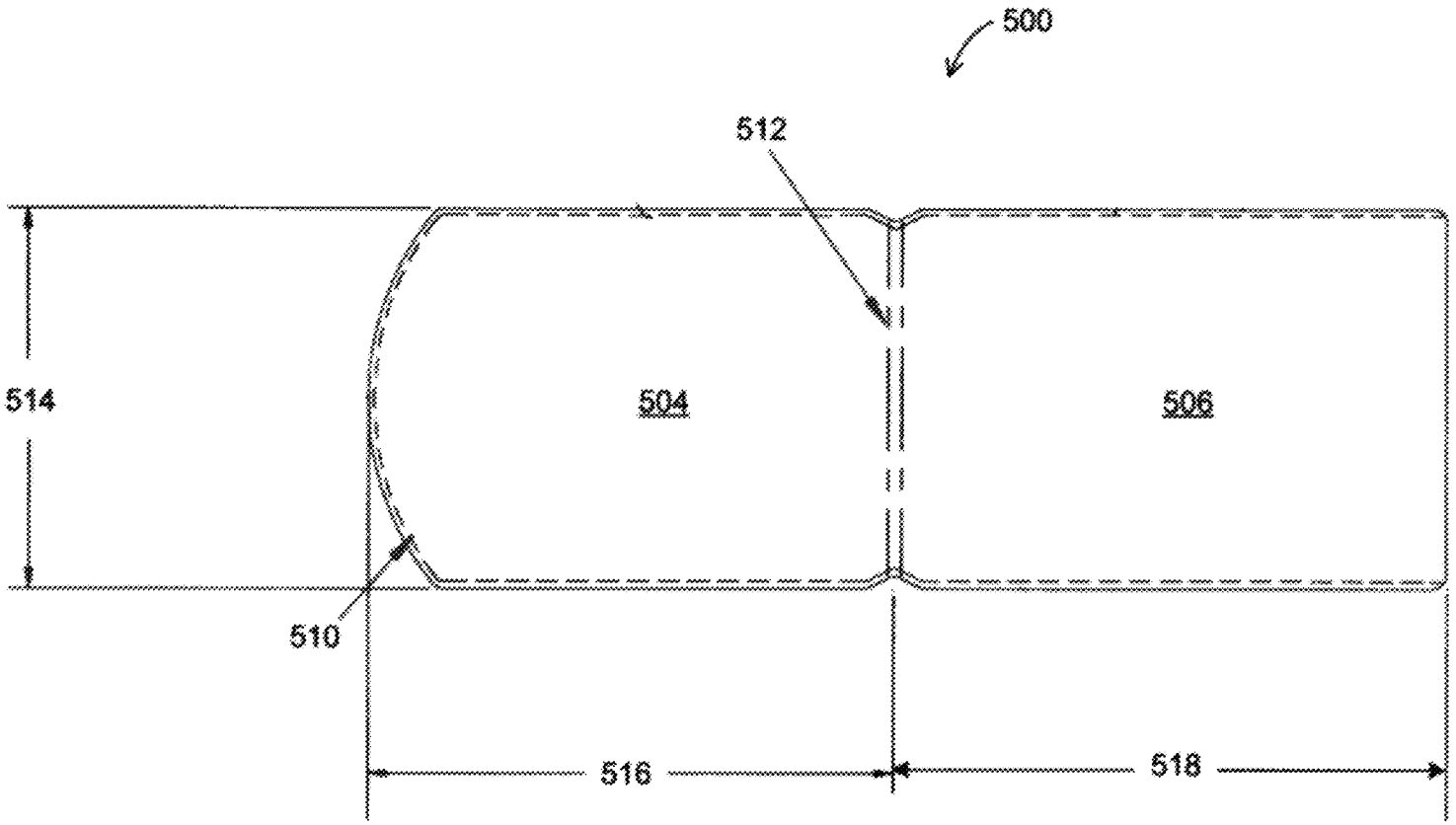
FIGS. 5 and 6 illustrate a particular implementation of an apparatus for protection or decoration of an open-ended container in accordance with this disclosure.
Figure 6:
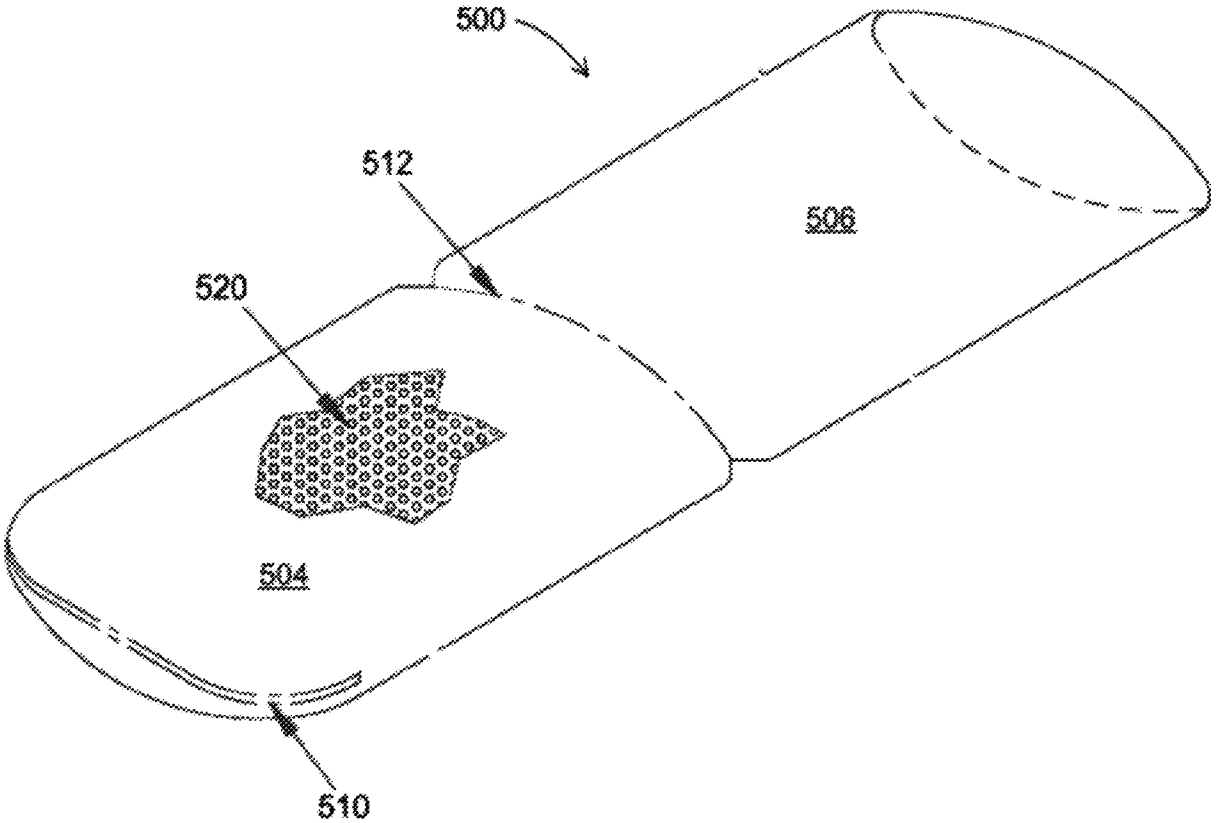

FIGS. 5 and 6 illustrate a particular implementation of an apparatus 500 for protection or decoration of an open-ended container in accordance with this disclosure. The apparatus 500 may represent a particular implementation of the apparatus 100 shown in FIGS. 1 through 4 and described above.

FIG. 5 presents a top view of the apparatus 500, which includes a lower portion 504 and an upper portion 506. In some embodiments, the apparatus 500 may be fabricated from two pieces of material. As depicted in FIG. 5, the pieces are laid one on top of the other and sewn along the top border, the left edge, and the bottom border (as arranged in FIG. 5) to form a tubular shape with an open end on the right. In other embodiments, the apparatus 500 may be formed from a single piece of material in a tubular shape, which may be fabricated with a sealed end 510 or with the end 510 sealed in a separate fabrication step.

The lower portion 504 is filled with a compressible material and sealed with a seam 512 or other closure to retain the filling material in the lower portion 504. The seam 512 may be sewn, glued, heat treated, or sealed by any other technique suitable to the material(s) of the lower portion 504 and the upper portion 506.

In some embodiments, the apparatus 500 is fabricated with a width 514 that may be selected based upon a maximum diameter of the open-ended container with which the apparatus 500 will be used. The lower portion 504 has a length 516 that may be selected based upon a maximum internal height of a bowl of the open-ended container. The upper portion 506 has a length 518 that may be selected based upon an external height of the bowl or upon a total height of the open-ended container.

In some embodiments, the end 510 of the lower portion 504 is curved as shown in FIG. 5. In other embodiments, the end 510 may be formed at a right angle to the sides of the lower portion 504. Also, in some embodiments, the end 510 is permanently sealed at fabrication. In other embodiments, the end 510 is sealed with a resealable zipper, drawstring, Velcro fastener, or other closure that may be operated by a user of the apparatus 500. This permits the user to select a material to use in filling the lower portion 504. Where the apparatus 500 is used as a decoration rather than as a packing aid, the lower portion 504 may be filled with chocolates, rice, or other material for gift, celebration, or other purposes.

The lower portion 504 and the upper portion 506 are described above as being fabricated from a single material. In other embodiments, the lower portion 504 may be fabricated from a first material, the upper portion 506 may be fabricated from a second material, and the two materials may be joined at the seam 512. The material for the lower portion 504 may be selected based upon any suitable characteristic. For instance, the material may be selected based upon the granularity or other characteristics of a filling material to maximize the number and size of locations at which the lower portion 504 contacts an inner surface of an open-ended container when inserted. The material for the upper portion 506 may be selected for thickness and cushioning of an outer surface of a bowl of the open-ended container, for durability over repeated uses of the apparatus 500, for decorative qualities, or for any other suitable reason.

FIG. 6 presents a cut-away view of the apparatus 500. A hidden edge of the open end of the upper portion 506 is depicted with a dashed line. The lower portion 504 is sealed by the seam 512 and the closure at the end 510 to retain a filling material 520 within the lower portion 504.

The lower portion 504 is shown in FIGS. 5 and 6 and described here as a covering material filled with a filler material. However, it will be understood that in other embodiments the lower portion 504 is formed from a material such as foam, sponge, folded nylon netting, or other suitable compressible material that does not require a covering material.

FIGS. 7 through 11 illustrate use of another example apparatus 700 for protection or decoration of an open-ended container in accordance with this disclosure. The embodiment of the apparatus 700 shown in FIGS. 7 through 11 is for illustration only. Other embodiments of the apparatus 700 may be used without departing from the scope of this disclosure.

Figure 7:
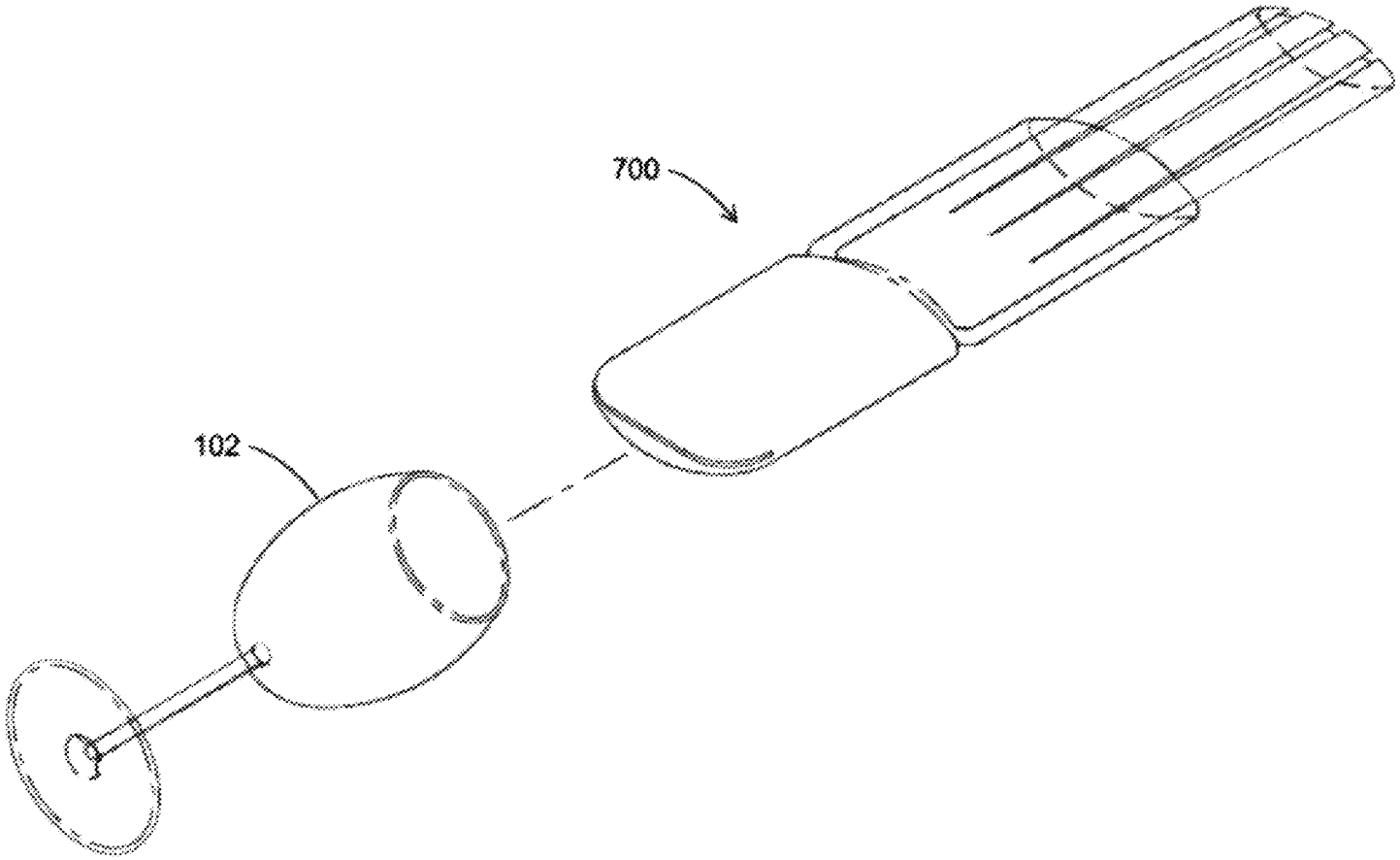
FIGS. 7 through 11 illustrate use of another example apparatus for protection or decoration of an open-ended container in accordance with this disclosure.
Figure 8:
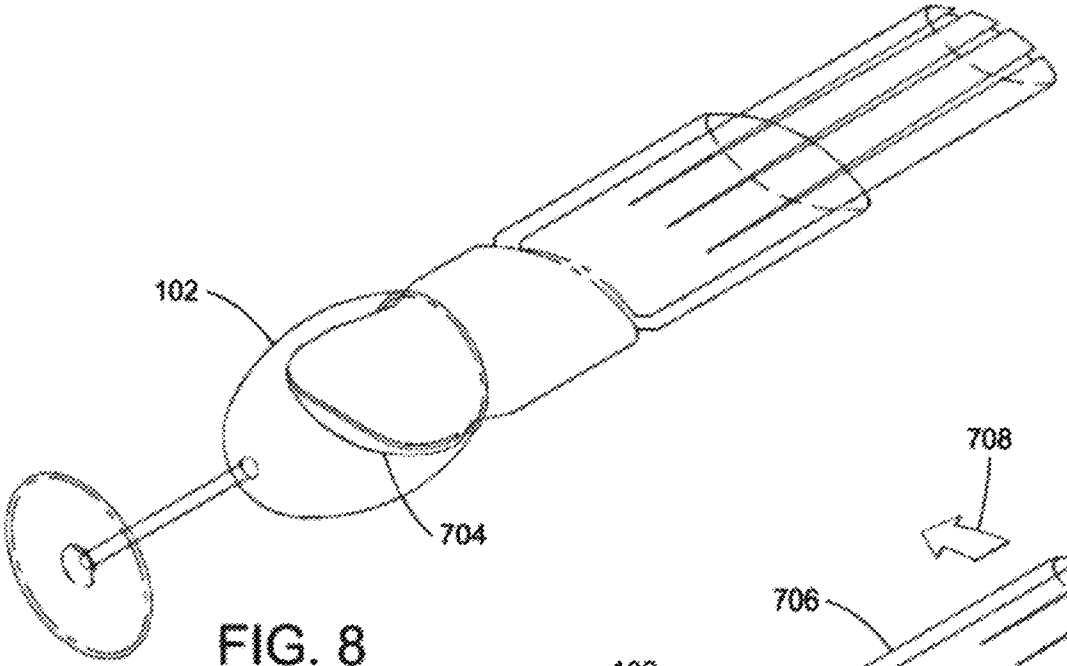
Figure 9:
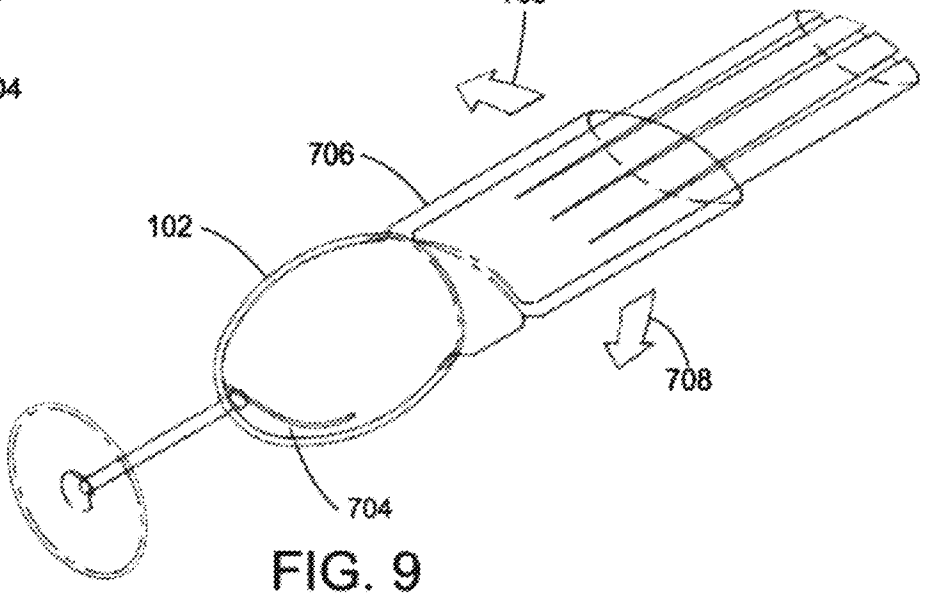

FIG. 7 shows the apparatus 700 aligned with the wine glass 102 for insertion. In FIG. 8, a lower portion 704 of the apparatus 700 is partially inserted into the bowl of the wine glass 102. In FIG. 9, substantially all of the lower portion 704 has been inserted in the bowl. Also in FIG. 9, it may be seen that an upper portion 706 of the apparatus 700 can be inverted over the outer surface of the bowl as shown by arrows 708.

Figure 10:
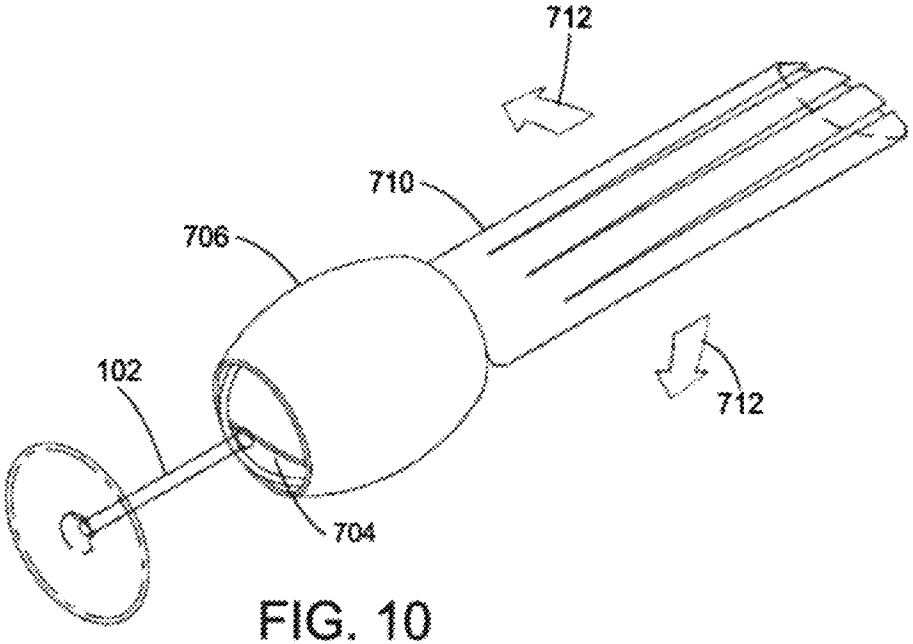
Figure 11:
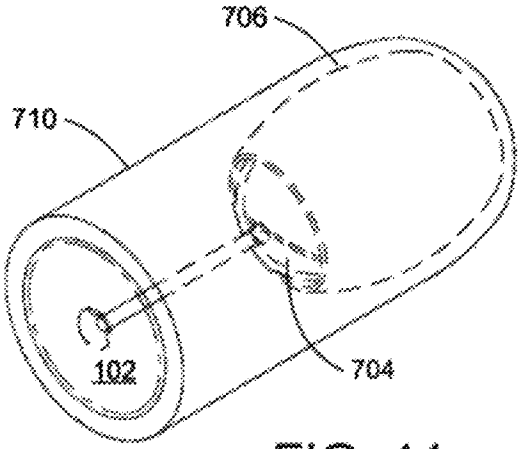

FIG. 10 illustrates an additional element of the apparatus 700, namely an overwrap portion 710. The overwrap portion 710 is formed from a material selected for decorative qualities, to provide additional protection to the wine glass 102, or for any other suitable reason. As with the upper portion 706, the overwrap portion 710 is inverted over the bowl and upper portion 706 and drapes the entire length of the wine glass 102 as shown in FIG. 11.

As can be seen in FIG. 10, the overwrap portion 710 may be formed in strips or any other outline or shape for decorative purposes. The overwrap portion 710 may be as long as the upper portion 706 or may be long enough to cover all of the wine glass 102. The overwrap portion 710 may include a logo, picture, graphic, design, or other image as desired to provide decoration or association with an institution, group, holiday, or event. The overwrap portion 710 and the upper portion 706 may be fabricated with any material(s) suitable for a desired function of the apparatus 700, such as impact protection, dust protection, decoration, or other purpose. In some embodiments, the overwrap portion 710 is attached at a seam or other closure attaching the upper portion 706 to the lower portion 704 such that the overwrap portion 710 is substantially the only portion of the apparatus 700 visible in the final configuration shown in FIG. 11.

In other embodiments, the overwrap portion 710 may be attached to the upper portion 706 at a position separated from the seam or other closure attaching the upper portion 706 to the lower portion 704. In such embodiments, a part of the upper portion 706 is visible to a selected distance along the length of the wine glass 102, while the overwrap portion 710 forms a lower wrap around the remainder of the wine glass 102. In particular embodiments, the apparatus 700 could be decorated to form a doll or other figure. For instance, the exposed part of the upper portion 706 could be decorated to resemble a shirt or blouse, the overwrap portion 710 could be decorated to resemble trousers or a skirt, and a head could be attached to the closure that attaches the upper portion 706 to the lower portion 704 such that the head sits atop the covered wine glass 102 in the final configuration shown in FIG. 11. In other embodiments, other decorative element(s) may be attached to the closure that attaches the upper portion 706 to the lower portion 704 to hide the closure.

Figure 12:
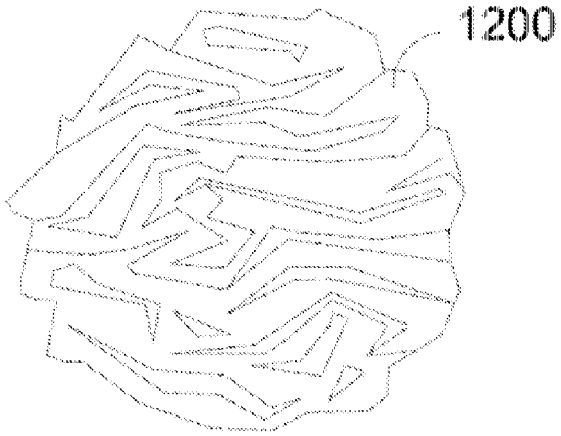
FIGS. 12 through 20 illustrate additional example apparatuses for protection or decoration of an open-ended container in accordance with this disclosure.

FIGS. 12 through 20 illustrate additional example apparatuses for protection or decoration of an open-ended container in accordance with this disclosure. FIG. 12 depicts an apparatus 1200 made of multiple pieces of nylon netting sewn together at an internal location and allowed to spread out in all directions (a "shower scrunchy"). This forms a compressible material suitable for use on its own as a lower portion (504 or 704) of an apparatus, such as one described above.

Figure 13:
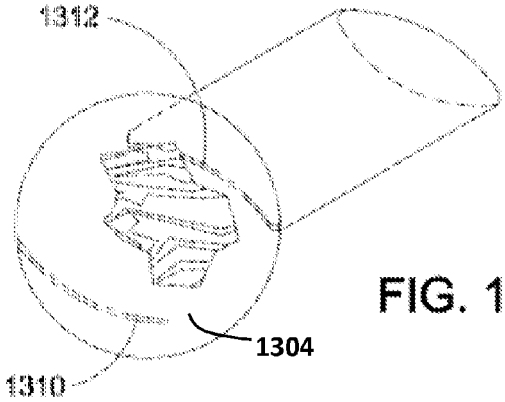

As shown in FIG. 13, however, a tubular piece of woven material, closed at one end 1310, may also be placed over the "shower scrunchy" and closed at a seam or closure 1312. This forms a lower portion 1304 of an apparatus, such as one described above.

Figure 14:
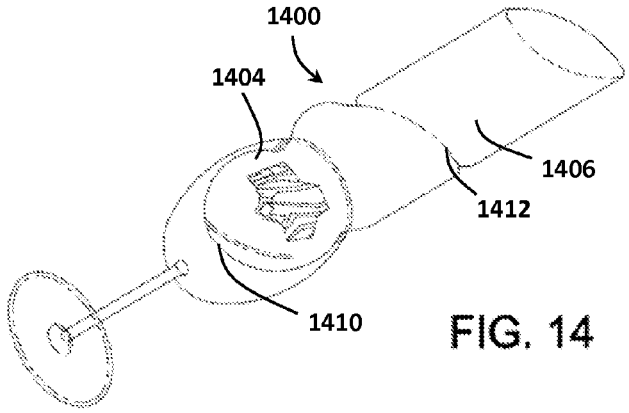
Figure 15:
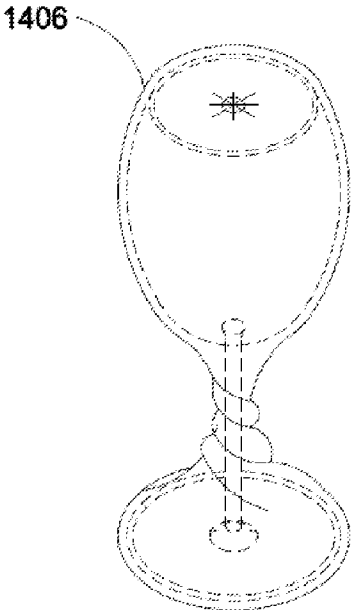

As shown in FIG. 14, in still another embodiment, an apparatus 1400 includes a tubular piece of netting having a closed end 1410 that may be placed over the "shower scrunchy" and closed at closure 1412. A remainder of the netting material forms an upper portion 1406 of the apparatus. In FIG. 14, the resulting lower portion 1404 is seen inserted into a bowl of a wine glass. In FIG. 15, the upper portion 1406 has been pulled down over substantially all of the exterior of the wine glass.

Figure 16:
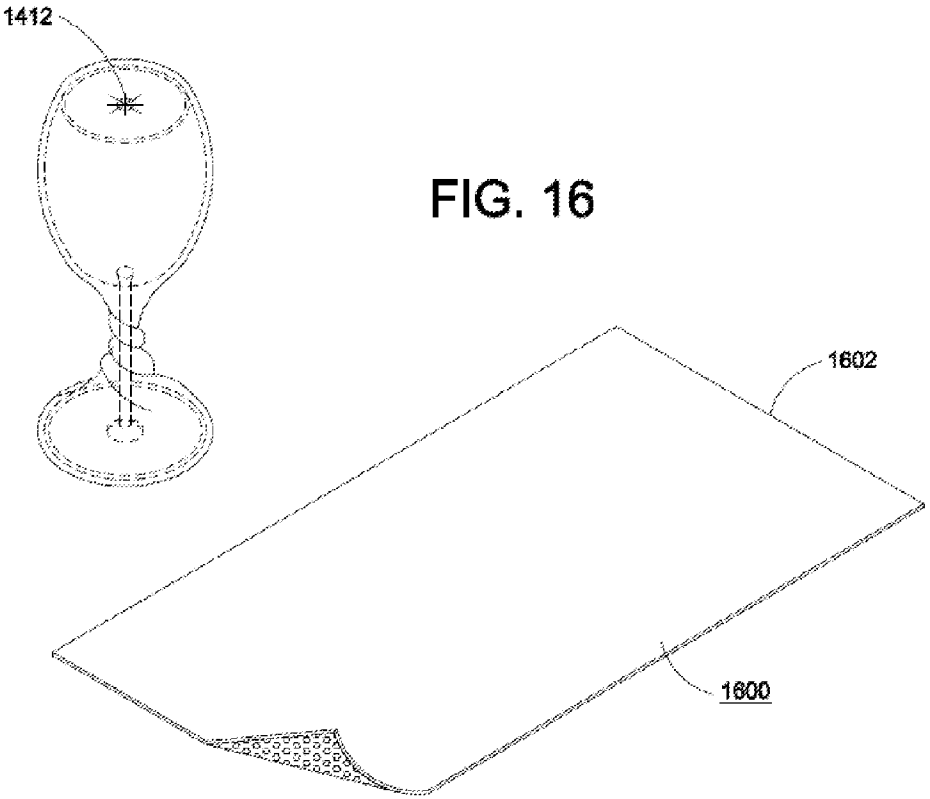
Figure 18:
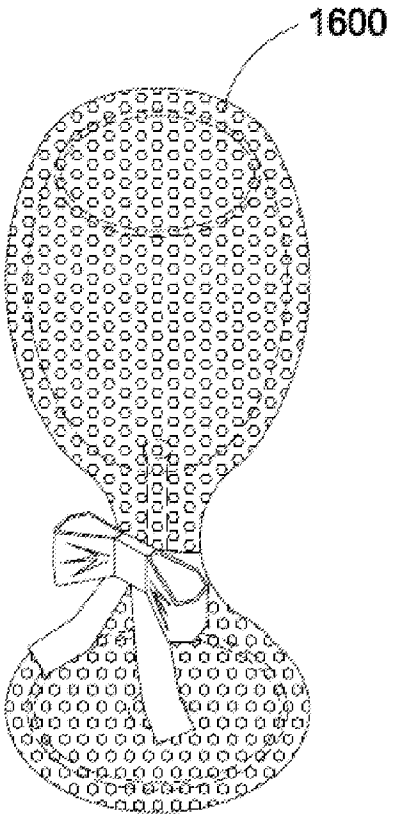
Figure 17:
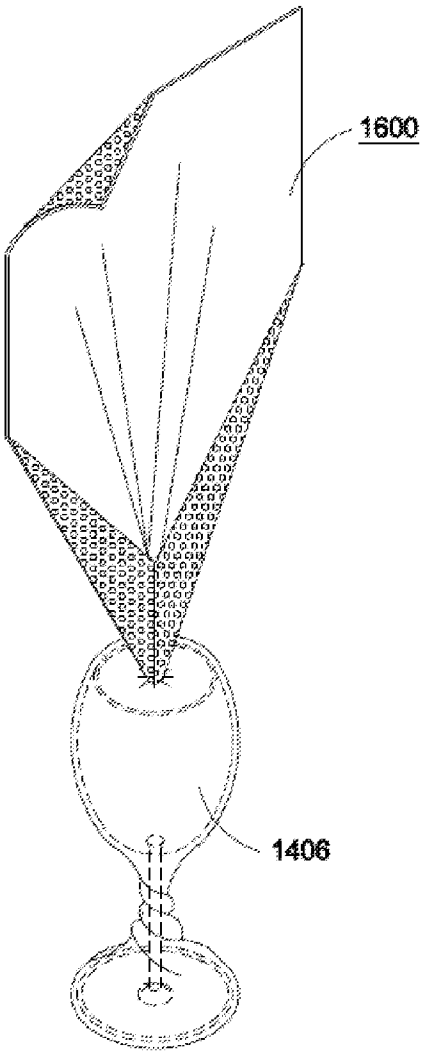

FIG. 16 shows a tubular overwrap portion 1600 that may be added to the apparatus 1400. As will be made clearer in subsequent figures, a decorative side of the overwrap portion 1600 is on the inside of the tube in FIG. 16. An edge 1602 of the overwrap portion 1600 may be attached to the seam or closure 1412 of the apparatus 1400, resulting in the configuration illustrated in FIG. 17. In FIG. 18, the overwrap portion 1600 has been inverted and pulled down over the upper portion 1406, revealing the decorative side of the overwrap portion 1600. A ribbon has been tied around the overwrap portion 1600 to gather the material around the stem of the wine glass. Note that the sequence shown in FIGS. 15, 16 and 17 appears to show the overwrap portion 1600 being attached to the apparatus 1400 after the apparatus 1400 is already installed in the wine glass. However, it will be understood that in other embodiments, the overwrap portion 1600 is attached to the apparatus 1400 during fabrication, and the resulting apparatus is provided to a user in a completed form.

Figure 20:
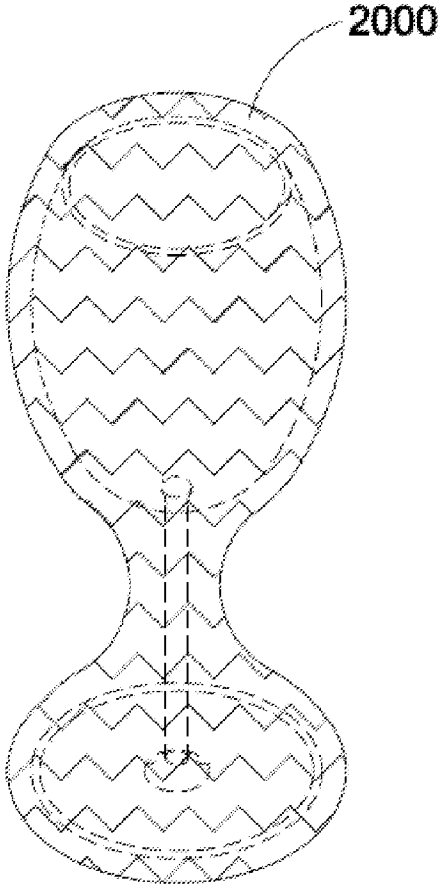
Figure 19:
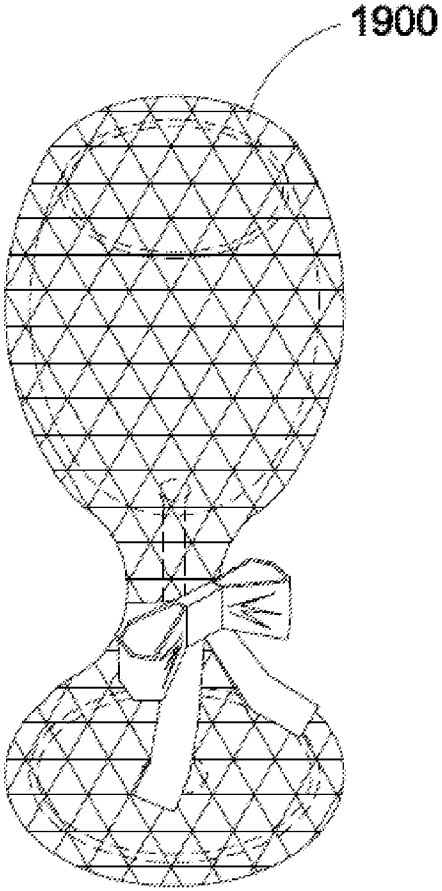

FIG. 19 shows an apparatus 1900 having an alternative decorative overwrap portion. FIG. 20 shows an apparatus 2000 having an alternative upper portion made of a thick elastic protective material (such as one that socks are made of). It may be seen from FIGS. 19 and 20 that an overwrap portion and/or an upper portion of an apparatus may be decorated with any desired picture, logo, graphic, or design for display while the apparatus is in use on an open-ended container.

Although the figures have illustrated example apparatuses for protection or decoration of an open-ended container, various changes may be made to FIGS. 1 through 20. For example, the use of a wine glass is for illustration only. The apparatuses described above could be used with any other suitable open-ended container. Note that an open-ended container could include a single opening (such as a glass, vase, etc.) or multiple openings. Also, each component of each apparatus could be formed using any suitable, material(s) and in any suitable manner.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a compressible lower portion adapted for compressed insertion into a hollow interior of an open-ended container, an expansion of the compressed lower portion causing the lower portion to contact an inner surface of the hollow interior along substantially all of the inner surface to facilitate applying pressure by the compressed lower portion against substantially all of the inner surface sufficient to aid in preventing breakage of the container; and an upper portion connected to the lower portion and capable for placement over an outer surface of the open-ended container opposite the hollow interior, the upper portion capable to contact the outer surface substantially along the entire length of the outer surface.

2. The apparatus of claim 1, wherein:

prior to placement over the outer surface of the open-ended container, the upper portion has a tubular shape with an open end distal from the lower portion; and the upper portion is adapted to be inverted to place the upper portion over the outer surface of the container.

3. The apparatus of claim 1, wherein the lower portion comprises a compressible filling material within a cover.

4. The apparatus of claim 1, further comprising:

an overwrap portion connected to at least one of the lower portion and the upper portion, the overwrap portion adapted for placement over the outer surface of the open-ended container and over the upper portion.

5. The apparatus of claim 4, wherein:

the upper portion is adapted for placement over at least a first portion or all of the open-ended container; and the overwrap portion is adapted for placement over at least a second portion or all of the open-ended container.

6. The apparatus of claim 1, wherein the lower portion is adapted to dampen vibrations in the open-ended container and to resist compression of the open-ended container.

7. The apparatus of claim 1, wherein the lower portion is adapted for insertion into a bowl of a drinking glass.

8. A system comprising:

an open-ended container; and an apparatus comprising:

a compressible lower portion adapted for compressed insertion into a hollow interior of the open-ended container, an expansion of the compressed lower portion causing the lower portion to contact an inner surface of the hollow interior along substantially all of the inner surface to facilitate applying pressure by the compressed lower portion against substantially all of the inner surface sufficient to aid in preventing breakage of the container; and an upper portion connected to the lower portion and capable for placement over an outer surface of the open-ended container opposite the hollow interior, the upper portion capable to contact the outer surface substantially along the entire length of the outer surface.

9. The system of claim 8, wherein:

prior to placement over the outer surface of the open-ended container, the upper portion has a tubular shape with an open end distal from the lower portion; and the upper portion is adapted to be inverted to place the upper portion over the outer surface of the container.

10. The system of claim 8, wherein the lower portion comprises a compressible filling material within a cover.

11. The system of claim 8, wherein the apparatus further comprises:

an overwrap portion connected to at least one of the lower portion and the upper portion, the overwrap portion adapted for placement over the outer surface of the open-ended container and over the upper portion.

12. The system of claim 11, wherein:

the upper portion is adapted for placement over at least a first portion or all of the open-ended container; and the overwrap portion is adapted for placement over at least a second portion or all of the open-ended container.

13. The system of claim 8, wherein the lower portion is adapted to dampen vibrations in the open-ended container and to resist compression of the open-ended container.

14. The system of claim 8, wherein the open-ended container comprises a drinking glass.

15. The system of claim 14, wherein:

the apparatus further comprises an overwrap portion connected to at least one of the lower portion and the upper portion;

the upper portion is adapted for placement over at least a bowl of the drinking glass; and the overwrap portion is adapted for placement over the upper portion, the bowl of the drinking glass, a stem of the drinking glass, and a base of the drinking glass.

16. A method comprising:

inserting a compressible lower portion of an apparatus into a hollow interior of an open-ended container, an expansion of the compressed lower portion causing the lower portion to contact an inner surface of the hollow interior along substantially all of the inner surface to facilitate applying pressure by the compressed lower portion against substantially all of the inner surface sufficient to aid in preventing breakage of the container; and placing an upper portion of the apparatus over an outer surface of the open-ended container opposite the hollow interior, such that the upper portion contacts the outer surface substantially along the entire length of the outer surface, the upper portion of the apparatus connected to the lower portion of the apparatus.

17. The method of claim 16, wherein:

prior to placement over the outer surface of the open-ended container, the upper portion has a tubular shape with an open end distal from the lower portion; and the upper portion is inverted to place the upper portion over the outer surface of the container.

18. The method of claim 16, further comprising:

placing an overwrap portion of the apparatus over the outer surface of the open-ended container and over the upper portion.

19. The method of claim 18, wherein:

the upper portion is placed over at least a first portion or all of the open-ended container; and the overwrap portion is placed over at least a second portion or all of the open-ended container.

20. The method of claim 19, wherein:

the open-ended container comprises a drinking glass;

the upper portion is placed over at least a bowl of the drinking glass; and the overwrap portion is placed over the bowl of the drinking glass, a stem of the drinking glass, and a base of the drinking glass.

* * * * *